US008860657B2

(12) United States Patent
Lee et al.

(10) Patent No.: US 8,860,657 B2
(45) Date of Patent: Oct. 14, 2014

(54) LIQUID CRYSTAL DISPLAY BACKLIGHT CONTROL

(71) Applicant: Marvell World Trade Ltd., St. Michael (BB)

(72) Inventors: Wonbok Lee, San Jose, CA (US); Vasudev Bhaskaran, San Diego, CA (US); Mainak Biswas, Santa Cruz, CA (US); Nikhil Balram, Mountain View, CA (US)

(73) Assignee: Marvell World Trade Ltd., St. Michael (BB)

( * ) Notice: Subject to any disclaimer, the term of this patent is extended or adjusted under 35 U.S.C. 154(b) by 0 days.

(21) Appl. No.: 14/228,544

(22) Filed: Mar. 28, 2014

(65) Prior Publication Data

US 2014/0225935 A1 Aug. 14, 2014

Related U.S. Application Data

(62) Division of application No. 12/783,123, filed on May 19, 2010, now Pat. No. 8,711,083.

(60) Provisional application No. 61/180,022, filed on May 20, 2009.

(51) Int. Cl.
*G09G 3/36* (2006.01)

(52) U.S. Cl.
CPC ..... *G09G 3/3607* (2013.01); *G09G 2360/145* (2013.01)
USPC ..... 345/102

(58) Field of Classification Search
CPC ..... G09G 3/3406
USPC ..... 345/102
See application file for complete search history.

(56) References Cited

U.S. PATENT DOCUMENTS

| | | | | |
|---|---|---|---|---|
| 7,460,103 | B2 | 12/2008 | Konno et al. | |
| 2003/0146919 | A1 | 8/2003 | Kawashima et al. | |
| 2007/0285382 | A1* | 12/2007 | Feng | 345/102 |
| 2008/0309811 | A1* | 12/2008 | Fujinawa et al. | 348/333.01 |
| 2011/0063276 | A1 | 3/2011 | Tan et al. | |
| 2011/0115826 | A1 | 5/2011 | Fujiwara | |
| 2012/0007896 | A1 | 1/2012 | Kwon et al. | |

FOREIGN PATENT DOCUMENTS

| | | |
|---|---|---|
| JP | 2004-110050 | 4/2004 |
| WO | WO 2009/054223 | 4/2009 |

OTHER PUBLICATIONS

Search Report and Written Opinion of International Searching Authority, International Application No. PCT/US2010/035425, Sep. 28, 2010.

* cited by examiner

*Primary Examiner* — Waseem Moorad

(57) ABSTRACT

To improve contrast ratio of the image on a backlit display plane such as a liquid crystal display ("LCD"), each area of the image that has separately controllable backlight may be given full backlight until an average or composite brightness of the image in that area is less than a threshold value at which light leakage through the image from full-strength backlight begins to be noticeable by a viewer. For image areas with composite brightness less than that threshold, backlight brightness may be reduced in proportion to how much below the threshold the area's composite image brightness is. Backlight brightness may also be adjusted for other image aspects such as (1) the presence of bright pixels in an otherwise relatively dark area, (2) whether the area is adjacent to one or more other areas in which the image information is in motion, and/or (3) time-averaging of image information over several successive frames of such information.

16 Claims, 14 Drawing Sheets

LIQUID CRYSTAL DISPLAY BACKLIGHT CONTROL

This is a division of commonly-assigned U.S. patent application Ser. No. 12/783,123, filed May 19, 2010, now U.S. Pat. No. 8,711,083, which claims the benefit of U.S. Provisional Patent Application No. 61/180,022, filed May 20, 2009, each of which is hereby incorporated by reference herein in its respective entirety.

BACKGROUND

The present disclosure relates generally to backlight control methodology, and more specifically, to local dimming of LED (Light Emitting Diode) backlights in LCD TVs (Liquid Crystal Display Televisions).

In a typical TFT-LCD (Thin Film Transistor-Liquid Crystal Display), an LC (Liquid Crystal) cannot illuminate by itself and requires light aids illuminating behind the LC panel from the observer's (viewer's) position. These types of light sources, known as backlights, are generally set to their maximum brightness, whereas different per-pixel grayscale values are applied to the LCs to regulate the amount of perceived brightness to observers, i.e., a pixel's grayscale works like a shutter controlling the (back-) light exposure from the pixel.

A problem with this structure is that backlight tends to leak through the panel even when pixel grayscale values are zero, ending up with poor "black level" representation. This leak (which is malignant to "black level" alone) originates from the innate structure of TFT, and it degrades the achievable Contrast Ratio (CR) in LCDs. Generally, CR is defined as the ratio of measured luminance of pure white to pure black from the panel. Accordingly, there is a need for minimization or at least reduction of backlight leak in areas with many black (or close to black) pixels, which, in turn would improve the CR for the entire picture.

To explain the concept of local dimming of LED backlights, it is helpful to understand the backlight structure of LCD TVs. Typically, a limited number of light sources, e.g., 1~8 CCFL (Cold Cathode Florescent Lamp) backlight(s), is used in an LCD TV, even though there are, at least, more than a million pixels in any panel. This implies that only 1~8 unit(s) of backlight is(are) independently settable to different luminance across the entire panel area. Even with Light Emitting Diode (LED) backlights (as an alternative to CCFL backlights), though the number of independently controllable units has increased, LED backlight controllable-unit granularity is much coarser than pixel granularity, mainly due to cost considerations. As a consequence, a certain area in the panel and all the pixels (which may be at different grayscale values) in that area need to be characterized to a single value such that this "composite" value determines the brightness of LED(s) underneath.

A typical LED backlight structure is shown in FIG. 1. In this FIG., 111 is the LC panel plane (shown in the foreground), and 112 is the LED backlight plane (shown in the background). In the backlight plane, each set of LEDs 113, 114, 115, 116, 117, 118, 119, 120, 121, or 122 in a rectangular grid indicates that this number of LEDs is settable as a whole in terms of brightness. The line extending between all of the LEDs in each LED group such as 113 indicates an electrical signal conductor that supplies a common amount of energy to every LED in that group. The level (e.g., the Pulse Width Modulation (PWM)) of duty ratio of the electrical signal on this conductor controls the viewer-perceived (i.e., time-averaged) brightness of all the LEDs in that group. Thus all the LEDs in any given group of LEDs have the same level of viewer-perceived brightness at any given time. But that level of brightness can be changed at various times (typically in sync with either a panel refresh rate or a time period per frame in video) by changing the PWM duty ratio of the control signal applied to those LEDs. Herein, a set of LEDs that is thus jointly controlled and settable to the same value of brightness is referred to as a "dimmable block".

Throughout this disclosure it may sometimes be helpful to provide a graphical indication of the brightness or relative brightness of certain features. These features can be either image information, backlight illumination, or both. See especially the "Key" portion of FIG. 1 where less or more shading is used to indicate lighter or darker areas, respectively, in order from A) (lightest (like white; LEDs at maximum illumination) to J (darkest (like black; LEDs off)). In some FIGS. only different amounts of shading from this FIG. 1 key are used to indicate different amounts of brightness according to this key scheme. Sometimes this keyed shading is augmented by additional use of the capital letters A-J as in the FIG. 1 key. This keyed shading (and the associated reference letters) are generally used to indicate only relative brightness of different areas within one FIG. or a closely related group of FIGS. The same shading (and letters) may indicate different levels of brightness in different FIGS., especially FIGS. that are not closely related to one another. The depiction of only ten different possible levels (A-J) of image brightness or LED illumination is generally a simplification that is employed for convenience herein, and it will be understood that in actual practice there are typically many more levels of illumination or brightness that are employed.

One simple yet effective method to reduce the light leak through LCs for image areas that are supposed to be darker is to lower the brightness of the backlight, and this is typically done by modulating the Pulse Width Modulation (PWM) duty ratio of the illumination signal provided to the backlight underneath the darker areas. (The PWM duty ratio is, for example, the ratio between (1) the amount of time that electrical power is applied to an LED, and (2) the amount of time that electrical power is not applied to that LED in the course of pulsatile energization of the LED.) Using this approach, CR is generally improved because the viewer-perceived brightness of pure white areas is largely preserved, while the viewer-perceived brightness of pure black areas is heavily decreased. Several commercially available LCDs employ backlight control techniques by following this rule. In a popular approach, the backlight is controlled based upon sloping line 211 in FIG. 2(*a*). Here the backlight brightness is linearly dimmed (PWM duty ratio decreases as $G_{block}$ decreases) across the entire grayscale, where $G_{block}$ is a representative grayscale value per dimmable block. (For all of the methods that are discussed herein, including the present method, it is assumed that an image is represented with 24 bits per pixel—8 bits for each of the three color components, namely, red (R), green (G), and blue (B)—thus $G_{block}$ is also in the range 0-255 (with 0 indicating darkest or "pure" black, and with 255 indicating brightest or "pure" white). However, the methods described here are applicable to other bit depths as well, e.g., 30 bits per pixel.) In FIG. 2(*a*), horizontal line 212 corresponds to the absence of backlight modulation, i.e., the backlight is always fully turned on regardless of the pixel's grayscale values.

Another popular approach dims the backlight based on curve 213 in FIG. 2(*b*). In this case, a piece-wise linear curve 213 over three different sub-ranges/bands is used. In both cases (211 in FIGS. 2(*a*) and 213 in FIG. 2(*b*)), maximum PWM duty ratio is assigned to pure white and minimum PWM duty ratio is assigned to pure black. Hence, in a particular image that consists only of pure black and pure white, the highest CR will be achieved.

SUMMARY

In accordance with certain possible aspects of this disclosure, a method is provided for controlling backlighting of a plurality of portions ("blocks") of a block-controllable display. The blocks may be arranged in a two-dimensional array that is co-extensive with the display. A block may include multiple pixels of the display. A block may have a respective backlight whose viewer-perceived brightness is controllable independently of the view-perceived brightness of other of the backlights. For successive frames of image information supplied for display by the display, the method may include (a) determining a composite grayscale value for a block from the image information for that block; (b) identifying a block as either still or moving depending on whether the image information for that block is still or moving, respectively; (c) additionally identifying a block that is immediately adjacent to a moving block as a filtered block; (d) for a block that is identified only as still, determining a backlight brightness value by applying a first brightness function to the composite grayscale value for that block; (e) for a block that is identified only as moving, determining a backlight brightness value by applying a second brightness function to the composite grayscale value for that block; (f) for a block that is identified as both filtered and still, determining a backlight brightness value as the greater of (i) a first intermediate backlight brightness value from applying the first brightness function to the composite grayscale value for that block, and (ii) a second intermediate backlight brightness value from applying a third brightness function to the greatest composite grayscale value of any moving block that is adjacent to that block; (g) for a block that is identified as both filtered and moving, determining a backlight brightness value as the greater of (i) a third intermediate backlight brightness value from applying the second brightness function to the composite grayscale value for that block, and (ii) the second intermediate backlight brightness value for that block; and (h) using the backlight brightness value determined for a block in control of the brightness of the backlight of that block.

In accordance with certain other possible aspects of the disclosure, in a method as summarized above, the identifying a block as either still or moving may include (a) determining an amount of change in the image information for that block between (i) the frame, and (ii) a preceding frame; and (b) comparing the amount of change to a threshold amount of change.

In accordance with certain still other possible aspects of the disclosure, the above-mentioned backlight brightness value determined for a block may be used in control of a pulse width modulation ("PWM") duty ratio for illumination of the backlight of that block.

In accordance with certain yet other possible aspects of the disclosure, the above-mentioned "using" operation may include (a) performing temporal filtering on successive frames on the backlight brightness value determined for a block to produce a temporally filtered backlight brightness value for that block; and (b) using the temporally filtered backlight brightness value to control the brightness of the backlight of that block.

In accordance with other possible aspects of the disclosure, display circuitry may include (a) a display plane including a plurality of pixels arranged in a block; (b) backlight circuitry for illuminating the block with a controllable amount of backlight; (c) circuitry for determining a grayscale characteristic of pixel data applied to the block; and (d) circuitry for determining an amount of backlight based at least in part on the grayscale characteristic, wherein when the grayscale characteristic has any value greater than a threshold value ($G_{LEAK}$) associated with a predetermined level of backlight leakage through a pixel, the amount of backlight determined by the circuitry for determining is a first amount, and when the grayscale characteristic has any value less than $G_{LEAK}$, the circuitry for determining reduces the amount of backlight from the first amount in proportion to how far the grayscale characteristic is below $G_{LEAK}$.

In accordance with certain other possible aspects of the disclosure, in circuitry as summarized above, the block may be one of a plurality of similar blocks in the display plane. In addition, the backlight circuitry may be one of a plurality of backlight circuitries, each of which illuminates a respective one of the blocks with a respective controllable amount of backlight. Still further, the circuitry for determining a grayscale characteristic may determine that grayscale characteristic, respectively, for each of the blocks. Yet further, the circuitry for determining the amount of backlight determines the amount of backlight for each respective block based at least in part on the grayscale characteristic of that block or the grayscale characteristic of another block that is adjacent to that block.

In accordance with still other possible aspects of the disclosure, liquid crystal display ("LCD") circuitry may include (a) an LCD including a plurality of blocks of pixels arranged in a two-dimensional array of intersecting rows and columns of the blocks, each of the blocks including a respective plurality of the pixels;

(b) backlight circuitry for illuminating each block with a respective controllable amount of backlight;

(c) circuitry for determining a grayscale characteristic of pixel data applied to each of the blocks;

(d) circuitry for determining an amount of motion in the pixel data applied to each of the blocks; and (e) circuitry for determining the amount of backlight for each of at least some of the blocks as a function, at least in part, of the grayscale characteristic and the amount of motion of that block.

Further features of this disclosure, its nature and various advantages will be more apparent from the accompanying drawings and the following detailed description.

BRIEF DESCRIPTION OF THE DRAWINGS

FIGS. 6A and 6B are sometimes referred to collectively as FIG. 6.

DETAILED DESCRIPTION

In accordance with certain possible aspects of this disclosure, full backlight may be provided for dimmable blocks whose average image brightness is anywhere in a range from maximum image brightness to a threshold level of image brightness that is relatively low but still above minimum image brightness. For example, this threshold level may be the level at which a viewer begins to perceive light leakage from full-strength backlight through an image region having that threshold level of image brightness. For dimmable blocks having average image brightness less than the above-mentioned threshold level, the backlight may be dimmed in proportion to how much below the threshold level the average image brightness of that dimmable block is. An example of this type of backlight control in accordance with this disclosure is shown in FIG. 2*c*. In FIG. 2*c*, $G_{LEAK}$ corresponds to the immediately above-mentioned threshold level.

As has just been briefly stated, the present disclosure may include control of backlight brightness by adjusting the PWM duty ratio as shown at 214 in FIG. 2*c*. In this embodiment the maximum PWM duty ratio is maintained above $G_{LEAK}$, while (quasi-) linearly decreasing the duty ratio when $G_{block}$ is in the range of $[0:G_{LEAK}]$. Note that the threshold value $G_{LEAK}$ may be based on subjective judgments, since the amount of light leak may not be easily or reliably determined on the basis of machine-measured luminance.

Figure 2A:
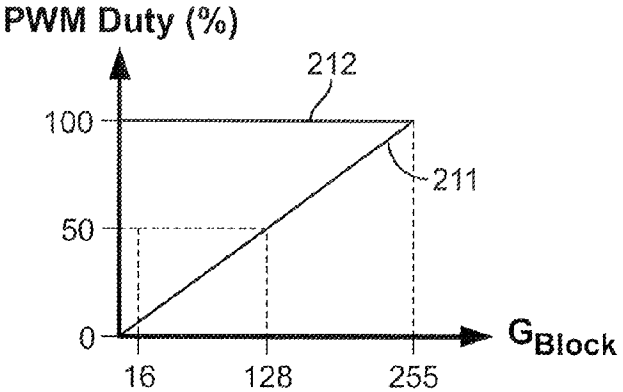
FIGS. 2*a-c* are simplified graphs of LED backlight control functions that are useful in explaining certain aspects of the disclosure.
Figure 2B:
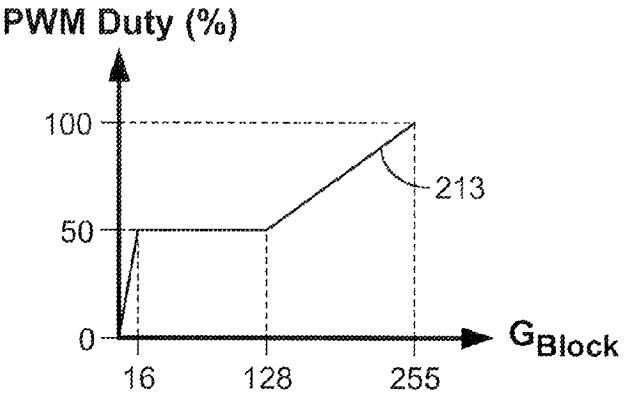
Figure 2C:
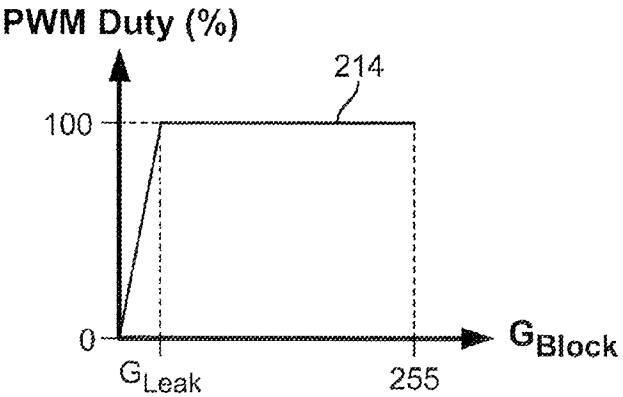
Figure 3:
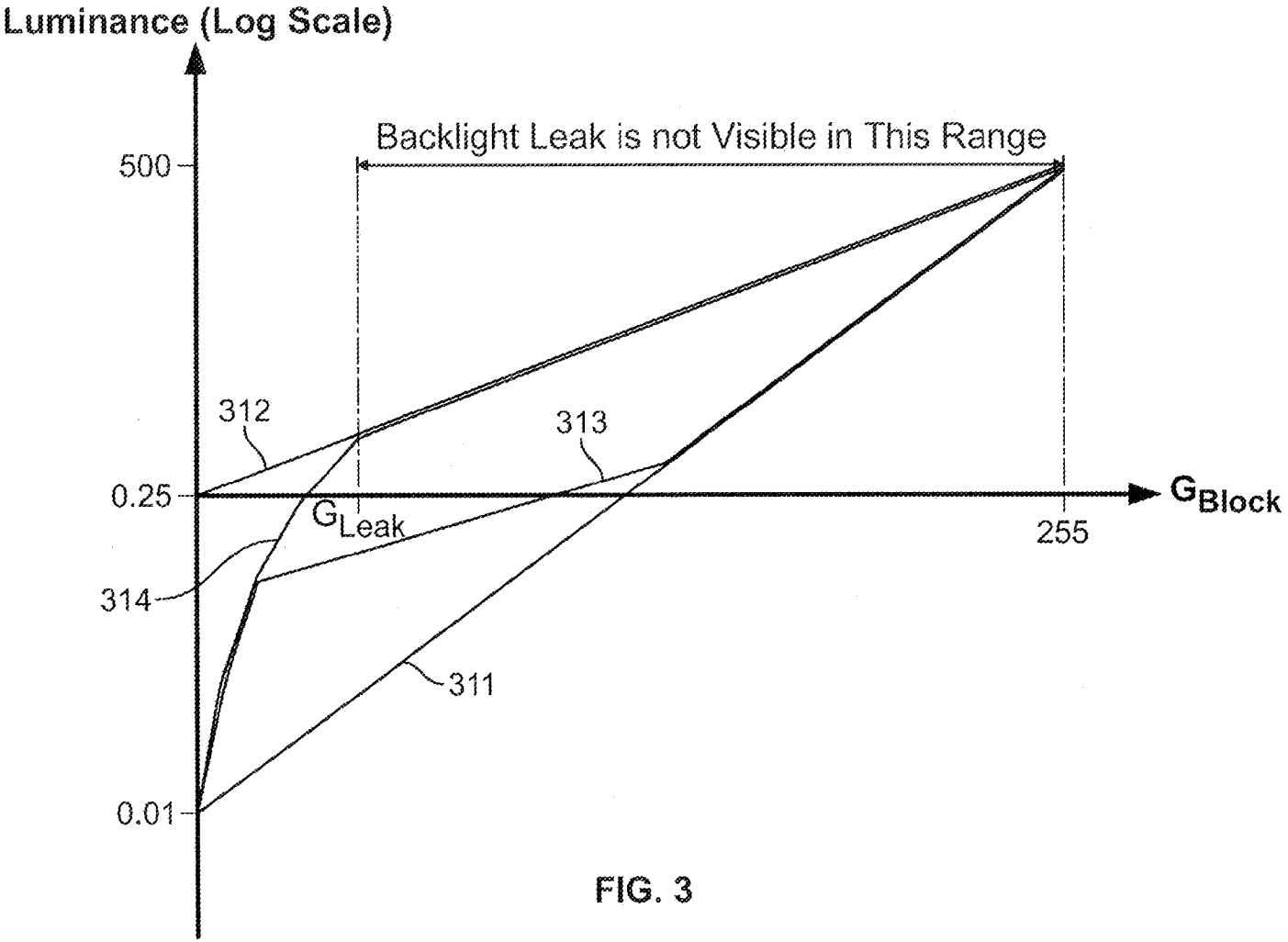
FIG. 3 is a simplified graph of the viewer-perceived image luminance effects of employing various LED backlight control functions.

To better understand how the different PWM mappings illustrated in FIG. 2 work, we estimate the performance of the FIG. 2*c* approach against other approaches as illustrated in FIG. 3. The y-axis in this FIG. is measured (or viewer-perceived) luminance from a panel. Note that the monotonically increasing luminance along line 312 originates from different grayscale values, i.e., $G_{block}$, for the case when the backlight is fully turned on for all grayscale values from 0 to 255. This corresponds to PWM duty ratio characteristic 212 in FIG. 2(*a*). Note that when $G_{block}=0$, characteristic 312 indicates that there is still significant luminance due to backlight leak.

In the case of linear dimming characteristic 311 (this is the case of PWM versus $G_{block}$ being a linear mapping function as in the case of characteristic 211 in FIG. 2(*a*)), as grayscale decreases, luminance consistently decreases across the entire grayscale range (referred to here as "full-range dimming") and this is done to achieve good-quality "black level". However, such full-range dimming will significantly degrade the original luminance (i.e., luminance level corresponding to 312) at every grayscale value, resulting in luminance degradation for the area and, ultimately, the whole image. Moreover, since the backlight leak is not visible when the grayscale is above $G_{LEAK}$, it is desirable to maintain the original luminance when $G_{block}>G_{LEAK}$, while adaptively decreasing the luminance as the perception of the "light leakage" increases. In characteristic 313 (this is the case of a PWM versus $G_{block}$ mapping function corresponding to characteristic 213 in FIG. 2(*b*)), luminance degradation has been reduced across the lower half of the grayscale. However, this method is also a full-range dimming method, and it suffers from a similar problem, i.e., it unnecessarily loses the original luminance when $G_{block}>G_{LEAK}$.

With herein disclosed characteristic 314, on the other hand, as $G_{block}$ decreases, this method (corresponding to herein disclosed FIG. 2*c*) reduces the original luminance only when $G_{block}<G_{LEAK}$ (i.e., the value of $G_{block}$ at which a viewer can begin to perceive backlight leakage through the LC from backlight having maximum brightness). In this case, original luminance at every grayscale value is preserved (in cases when $G_{block}\geq G_{LEAK}$), while effectively reducing the backlight leak as much as necessary (in cases when $G_{block}<G_{LEAK}$). As a consequence, this method largely preserves the original luminance per dimmable block and, ultimately, the image, while it effectively reduces the backlight leak per dimmable block.

Figure 4:
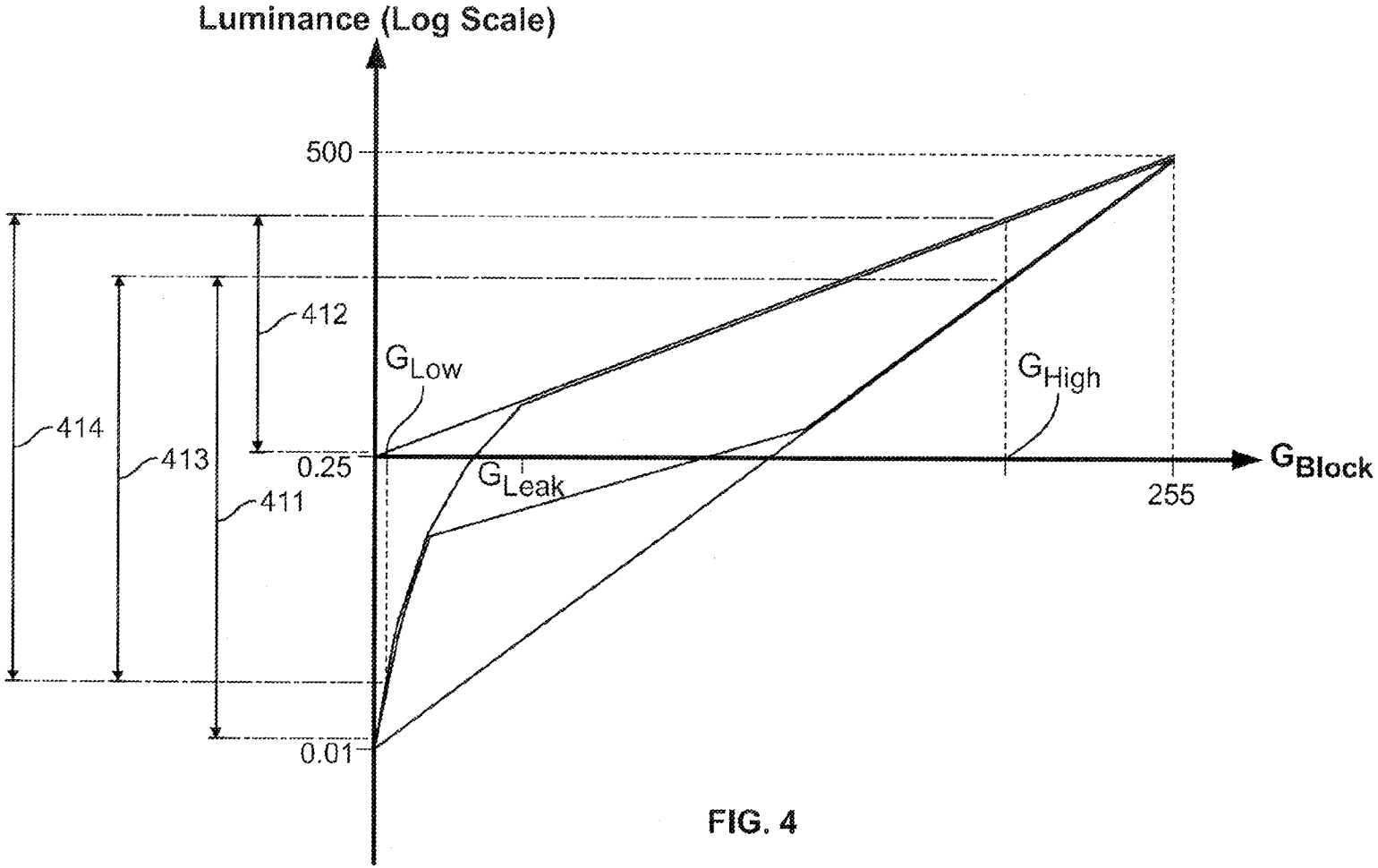
FIG. 4 is similar to FIG. 3 with some additional parameters indicated.

FIG. 4 shows performance of the FIG. 2*c* approach against other approaches when the representative grayscale for dimmable blocks in an arbitrary image is in the range of $[G_{low}:G_{high}]$. 412 is the estimated range between the maximum and minimum luminance in the absence of backlight modulation (as shown by 212 in FIG. 2*a*), 411 is the estimated range per characteristic 211 in FIG. 2*a*, 413 is the estimated range per characteristic 213 in FIGS. 2*b*, and 414 is the estimated range per the approach shown in FIG. 2*c*. In 411, although the range appears to be comparable to the range in 414, luminance at $G_{high}$ is quite low compared to the luminance at $G_{high}$ in 414, indicating that the originally brightest area in an image may not be as bright as it was. The herein-disclosed FIG. 2*c* approach (314 in FIG. 3) therefore advantageously provides high CR and high brightness, as well as low backlight leak.

In the previous paragraphs, a PWM mapping scheme (e.g., FIG. 2(*c*)) was presented. This requires correct characterization for each of the dimmable blocks to a representative grayscale value, $G_{block}$, since this single composite value or characteristic will maintain the luminance of the area (by turning on the backlights underneath as much as needed) and also reduce the backlight leak in that area (by dimming the backlights as much as needed). A simple method is the use of grayscale value average ($G_{avg}$) in the block to compute or determine $G_{block}$ for the block, and this average-based approach generally works well in most cases. However, there is a worst-case scenario that this characterization needs to consider: Though the $G_{avg}$ for a dimmable block guides the backlight to a very low value, such drastic control may need to be modified to account for the possible occurrence of a non-negligible number of high grayscale values in the block. For example, when a dimmable block (N×M pixels) has mostly dark pixels but some of the pixels correspond to pure white, the average grayscale in this block may be say, $G_{avg}=16$, which in turn may result in aggressive dimming of the backlight underneath the area and thus the few bright pixels will appear dark. To avoid such a worst-case scenario, our $G_{block}$ calculation may slightly adjust/increase the conventional $G_{avg}$ of a block by a certain amount so as to reflect the non-negligible portion having high grayscale values. The dimmable block characterization may therefore be given by the following formula, where $G_{SPLIT}$ represents a threshold that decides high grayscale values, e.g., 225. Note that $G_{block}=G_{avg}$ when $\alpha=0$, and that different $\alpha$ values (greater than 0, up to a maximum of 1) can be used depending on the severity of this scenario.

$$G_{block} = \frac{1}{NxM}\left[\sum_{x=1}^{N}\sum_{y=1}^{M} g(x, y)\right] + \frac{\alpha}{NxM}\left[\sum_{x=1}^{N}\sum_{y=1}^{M} g'(x, y)\right]$$

where $g'(x,y)=g(x, y)$ if $g(x,y)>G_{SPLIT}$ $g'(x,y)=0$ otherwise, $g(x,y)$ is the grayscale value for the pixel location (x,y), N: No. of pixels in the vertical direction, M: No. of pixels in the horizontal direction, $\alpha$: weighting factor [0:1].

It will be appreciated that (when alpha is greater than 0) the above equation for computing $G_{block}$ gives greater weight to any pixels whose luminance value is greater than $G_{SPLIT}$. This greater weight increases as the value of alpha increases.

Figure 5:
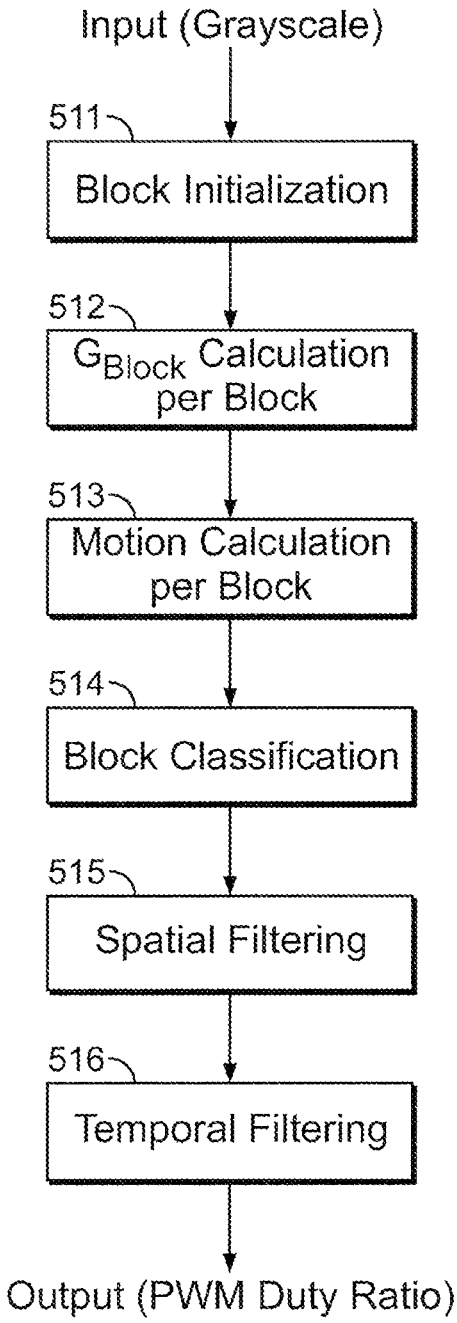
FIG. 5 is a simplified flow chart of an illustrative embodiment of backlight control methods in accordance with certain possible aspects of this disclosure.

FIG. 5 provides a high-level view of an illustrative embodiment of a local dimming procedure in accordance with this disclosure. Basically, this procedure works on an individual frame basis. (A "frame" is typically one complete video image. A frame is typically visible for only a fraction of a second, and then it is replaced by the next succeeding frame. A frame is made up of all the dimmable blocks that can be seen by a viewer of the LCD TV image screen.)

Figure 10A:
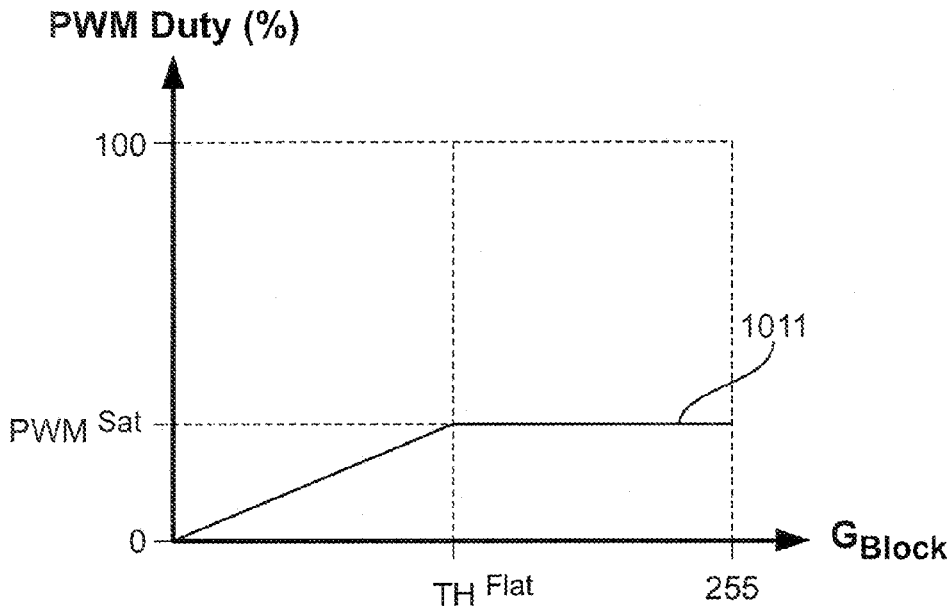
FIG. 10*a* is another simplified graph of an illustrative LED backlight control function in accordance with certain possible aspects of the disclosure.
Figure 10B:
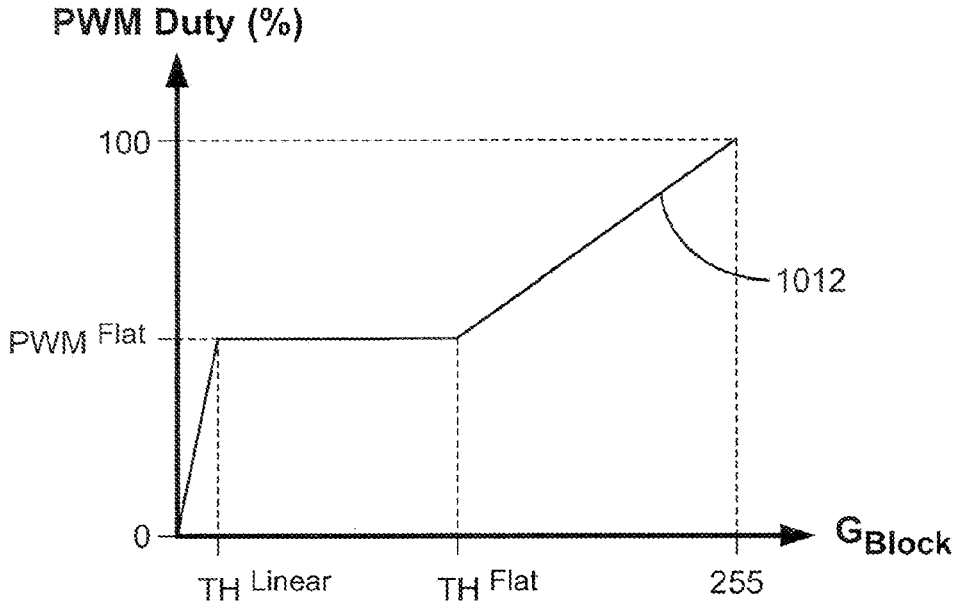
FIG. 10*b* is a simplified graph of still another illustrative backlight control function in accordance with certain possible aspects of the disclosure.

At the start of each frame of the input video, at 511 block initialization initializes all the dimmable blocks for the image to designation (for purposes of this process) as still blocks ($Block^s$). Then at 512 $G_{block}$ for each of the blocks is calculated. This may be done using the above equation, employing any desired value of alpha in the range 0-1, inclusive. At 513, the amount of per-block frame-to-frame motion is calculated and compared against a threshold value ($TH^{motion}$). Based on the result at 513, each block is classified at 514 as either a still block or a block in motion ($Block^m$). For each block in motion, 514 also classifies all of that block's surrounding (immediately adjacent) blocks as spatially-filtered blocks ($Block^f$). In this context, the notion of spatial filtering relates to whether the surrounding blocks' backlight(s) around the currently processing block need to go through backlight modulation other than that for a still block. The process of block classification and spatial filtering is further explained in later sections of this disclosure. Next, at 515, the PWM duty ratio for each block is set following the mapping curves in one of three FIGS. as follows:

1) FIG. 2(*c*) if the block is uniquely identified as a still image block;

2) FIG. 10(*b*) if the block is uniquely identified as a block in motion; or 3) FIG. 10(*a*) if the block is marked to be spatially-filtered.

Figure 6A:
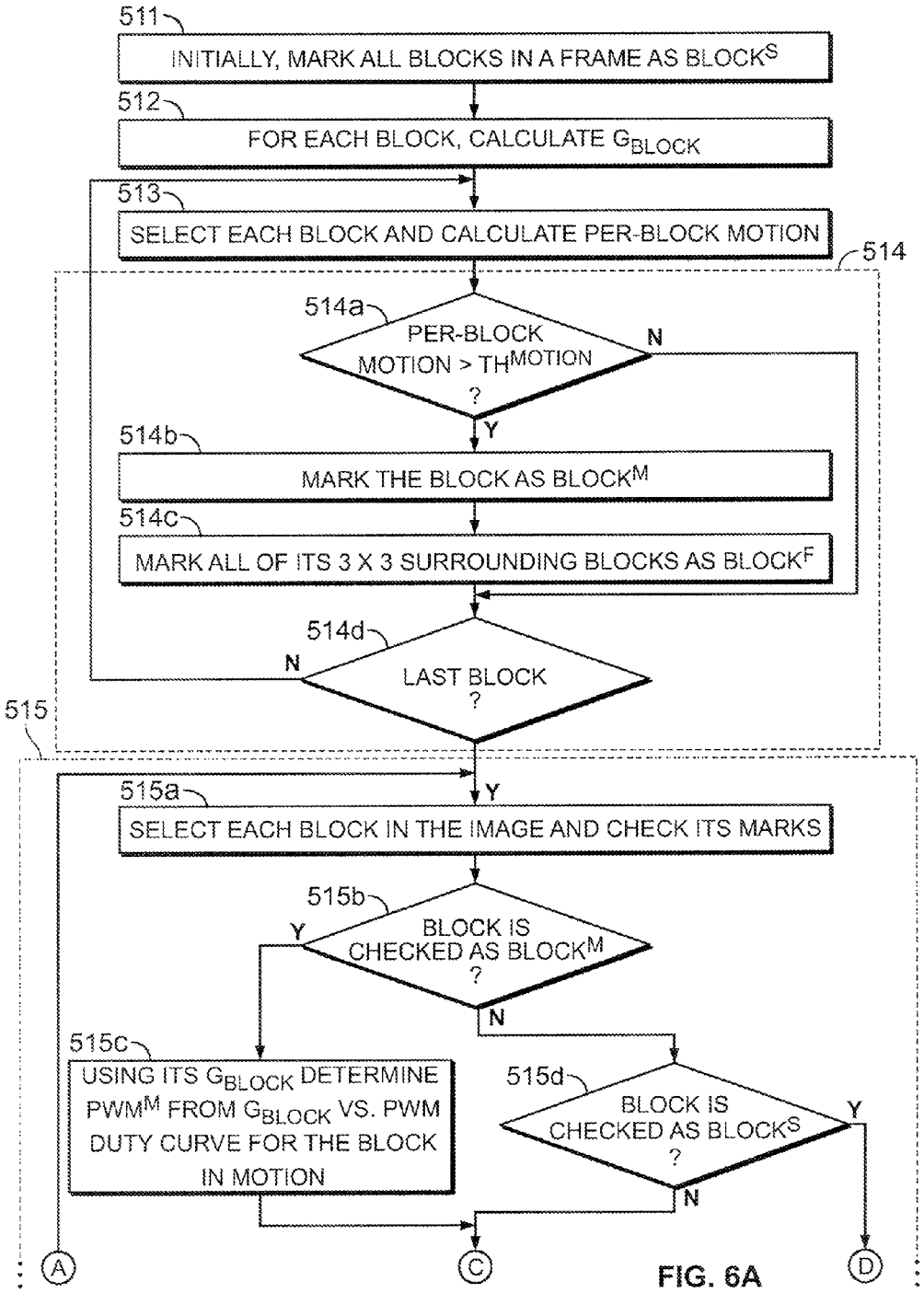
FIGS. 6A and 6B show a more detailed illustrative embodiment of what is shown in FIG. 5.
Figure 6B:
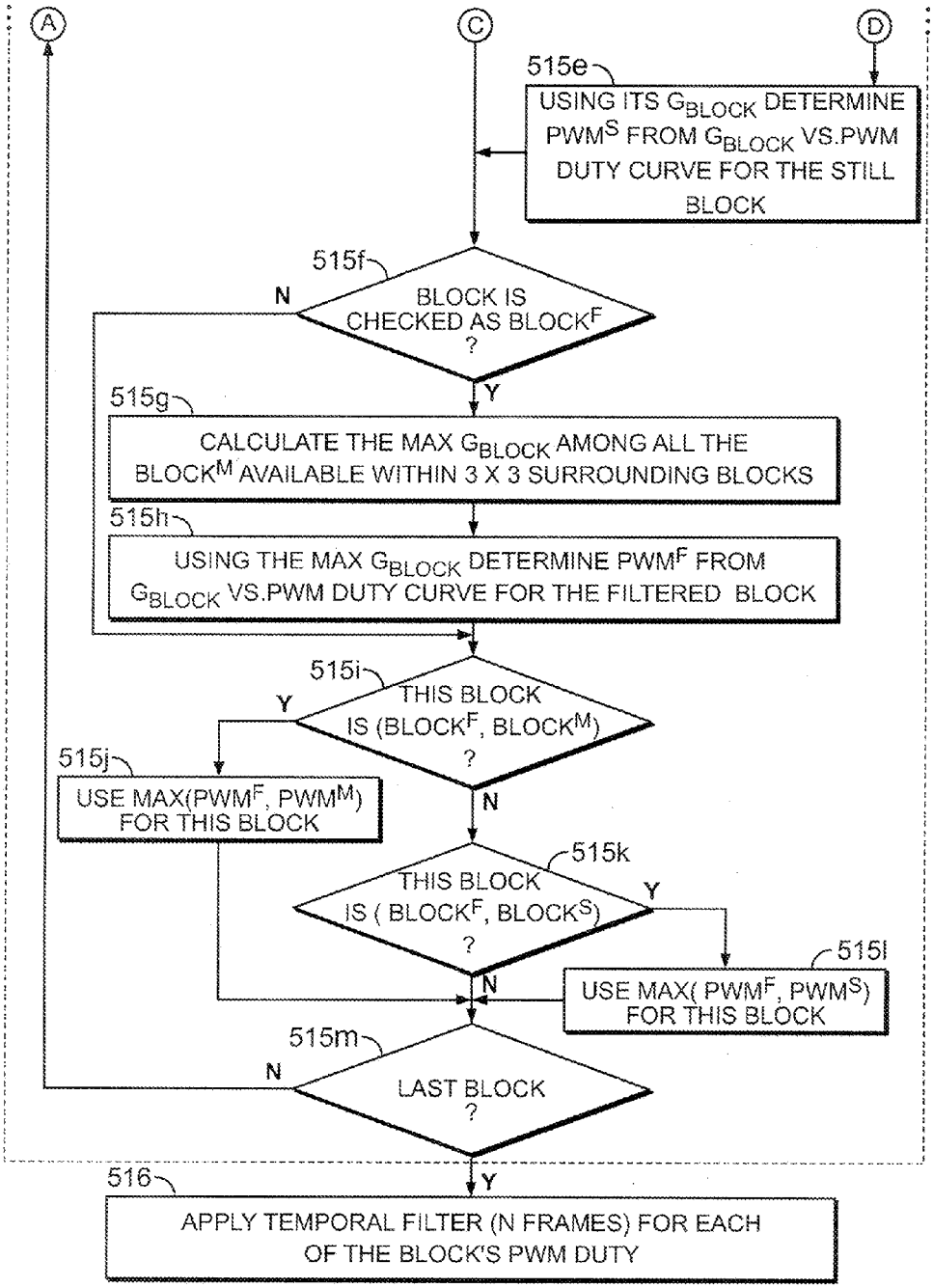

The first two cases are exclusive of each other, i.e., a block can be either a still block or an in-motion block; while the last case is inclusive of the first two cases. If a block is doubly classified (e.g., still and filtered (meaning spatially-filtered), or in motion and filtered), the maximum PWM duty ratio between the two relevant curves (e.g., select between FIG. 2(*c*) and FIG. 10(*a*) for the former case, or select between FIG. 10(*b*) and FIG. 10(*a*) for the latter case) is selected. Finally, per-block temporal filtering is applied at 516. FIG. 6 shows the subject matter of FIG. 5 in more detail, and more detailed discussion is also provided in later sections.

The next few paragraphs discuss the necessity for the above-mentioned spatial filtering.

In the still image (block) case, $G_{block}$ will determine the PWM duty ratio of the backlight(s) underneath that block, which in turn will selectively maintain (/reduce) the backlight brightness (/leak). Hence, in the still image case, a spatial filtering from the surrounding blocks is not needed. However, spatial filtering is necessary for moving images because without spatial filtering, 1) there might be luminance fluctuation inside a moving object, 2) there might be halo/leakage fluctuation outside of the moving object, and 3) there might be regional luminance degradations inside the moving object. All of these might be thought to be "temporal" variation for a moving object in that they spatially repeat on every grid (dimmable LED block boundary) over time, giving a false impression of temporal variation.

Figure 7:
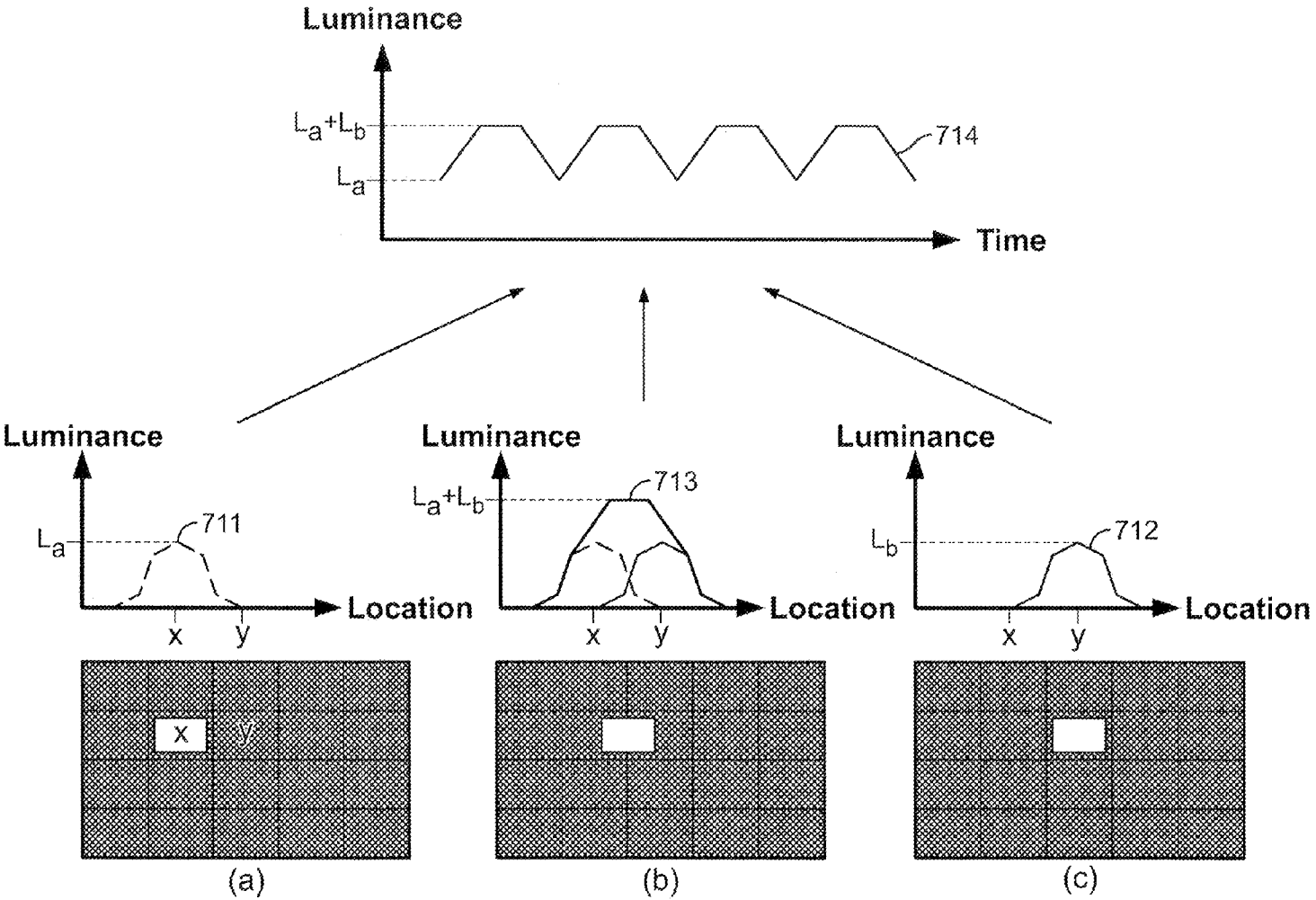
FIG. 7 (including parts (a)-(c)) is a simplified depiction of some illustrative image information that is useful in explaining certain possible aspects of the disclosure.

FIG. 7 depicts a scenario for luminance fluctuation. When a bright object moves into a block x in FIG. 7(*a*), this results in backlight underneath that block being set to 100% PWM duty ratio. Here (and in other subsequent FIGS. of the same general kind) each rectangle within the grid is one dimmable block. 711 approximates this backlight luminance with a maximum luminance of $L_a$. Later, when the object moves into block y in FIG. 7(*c*), backlight underneath that block will be set to 100% PWM duty ratio. 712 approximates the backlight luminance for block y with a maximum luminance of $L_b$. In the midst of this movement when the object is straddling two dimmable blocks as shown in FIG. 7(*b*), backlights in both blocks will be set to 100% PWM duty ratio. 713 approximates the combined backlight luminance observable from this object. At this moment, the inside of this object appears to be brighter, i.e., its luminance will be, at best, $L_a+L_b$, which is almost twice the observable luminance in 711/712. Moreover, at this time, a leak/halo appears in the surrounding area of the object (especially in the remainders of blocks x and y), while it is hardly observable in 711/712. These two fluctuations, both inside and outside the moving object, repeat on every grid boundary that is crossed by the moving object. 714 depicts the inside fluctuation for this object over time.

Figure 8:
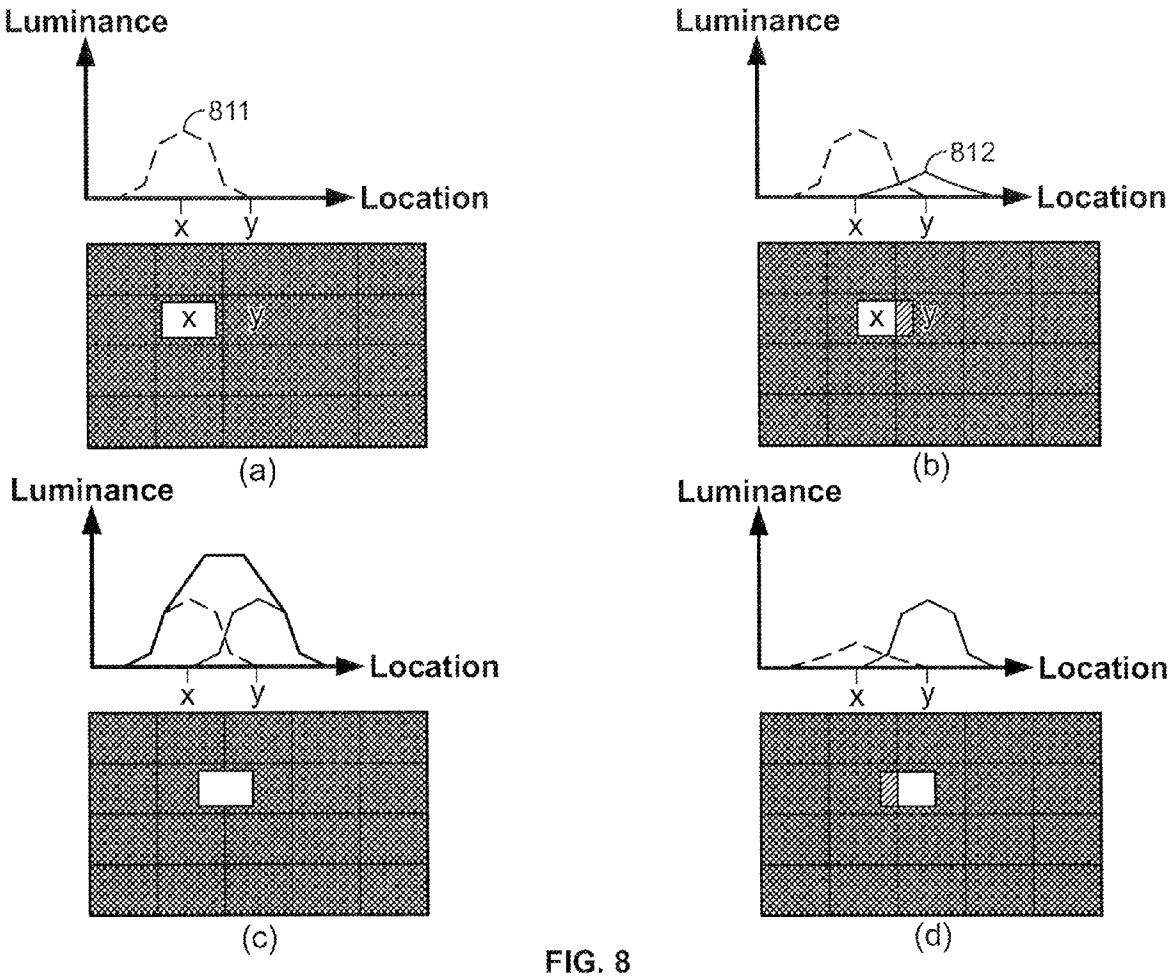
FIG. 8 (including parts (a)-(d)) is a simplified depiction of some other illustrative image information that is useful in explaining certain possible aspects of the disclosure.

FIG. 8 depicts a scenario for regional luminance degradation (which may be especially noticeable for slowly moving objects). When a bright object moves into block x in FIG. 8(*a*), backlight underneath the block will be set to 100% PWM duty ratio. 811 approximates the backlight luminance at this moment. Later, when the object moves and partially enters block y in FIG. 8(*b*), low $G_{block}$ on block y guides its backlight underneath to a low PWM duty ratio, temporarily creating a "locally shaded area" within this bright object. 812 approximates the backlight luminance for block y at this moment. When the object further moves as shown in FIG. 8(*c*) and FIG. 8(*d*), "locally shaded area" is again observable in block x in FIG. 8(*d*). Such local luminance degradation repeats on every grid boundary that is crossed by the moving object.

To resolve the above-mentioned issues for an object in motion, an effective solution is spatial filtering of the backlights, i.e., turning on the backlights in some of the blocks surrounding the moving object more strongly. Using spatial filtering, luminance fluctuation and regional luminance degradation will be reduced, and leak/halo fluctuation will disappear. However, some amount of leak/halo will be present constantly, i.e., turning-on of the surrounding blocks in a certain amount will largely hide the luminance fluctuation/degradation at the cost of leak/halo. Since the luminance of the object is more highly noticeable (it is, at least, three orders of magnitude higher than the luminance of leak/halo), spatial filtering is highly desirable for the moving object. An illustrative filter design selects a 3×3 block range around any object in motion and the PWM duty ratio in each of 3×3 surrounding blocks is chosen following the pseudo-code below (which is cross-referenced to corresponding elements in FIG. 6 by means of the reference numbers and letters in parentheses).

In each frame, classify each block into one of three types (512-514).

Unchanging/still blocks ($Block^s$) versus blocks in motion ($Block^m$) (512-514).

This separation is based upon 1) summation of per-pixel differences per block over any consecutive two frames, and 2) comparison of the result against a per-block motion threshold value ($TH^{motion}$) (512-514). (Any other suitable technique for determining whether or not a block is in motion can be used instead if desired.)

Blocks around the $Block^m$ ($Block^f$) in a 3×3 block range (514*c*)—blocks to be spatially filtered.

Define three types of ($G_{block}$ versus PWM duty ratio) curves for $Block^s$, $Block^m$, and $Block^f$, respectively (515, 515*a*). In the present notation, $G_{block}$ and PWM duty ratio at block (i,j) are represented by $G_{block}(i,j)$ and PWM(i,j), respectively.

$Block^s$—Use the FIG. 2(*c*) curve (515*d*, 515*e*).

$PWM^s(i,j)$ is derived from $G_{block}(i,j)$ (512, 515*e*).

$Block^m$—Use a double-band (FIG. 10*b*) curve (515*b*, 515*c*).

$PWM^m(i,j)$ is derived from $G_{block}(i,j)$ (512, 515*c*).

$Block^f$—Use a saturation (FIG. 10*a*) curve (515*f*-515*h*).

From the curve, $PWM^f(i,j)$ is derived from $G_{block}=Max(G_{block}(i+p,j+q))$ where $(-1<p<1)$, $(-1<q<1)$, $(p\neq0,q\neq0)$, and $G_{block}(i+p,j+q)=0$ if the block at (i+p,j+q) is not marked as $Block^m$ (515*g*, 515*h*).

For each block,

If ($Block^m$) then $PWM\leftarrow PWM^m$ (515*c*);

If ($Block^s$) then $PWM\leftarrow PWM^s$ (515*e*);

If ($Block^f$ AND $Block^m$) then $PWM\leftarrow Max(PWM^f, PWM^m)$ (515*i*, 515*j*);

If ($Block^f$ AND $Block^s$) then $PWM\leftarrow Max(PWM^f, PWM^s)$ (515*k*, 515*l*).

Figure 9:
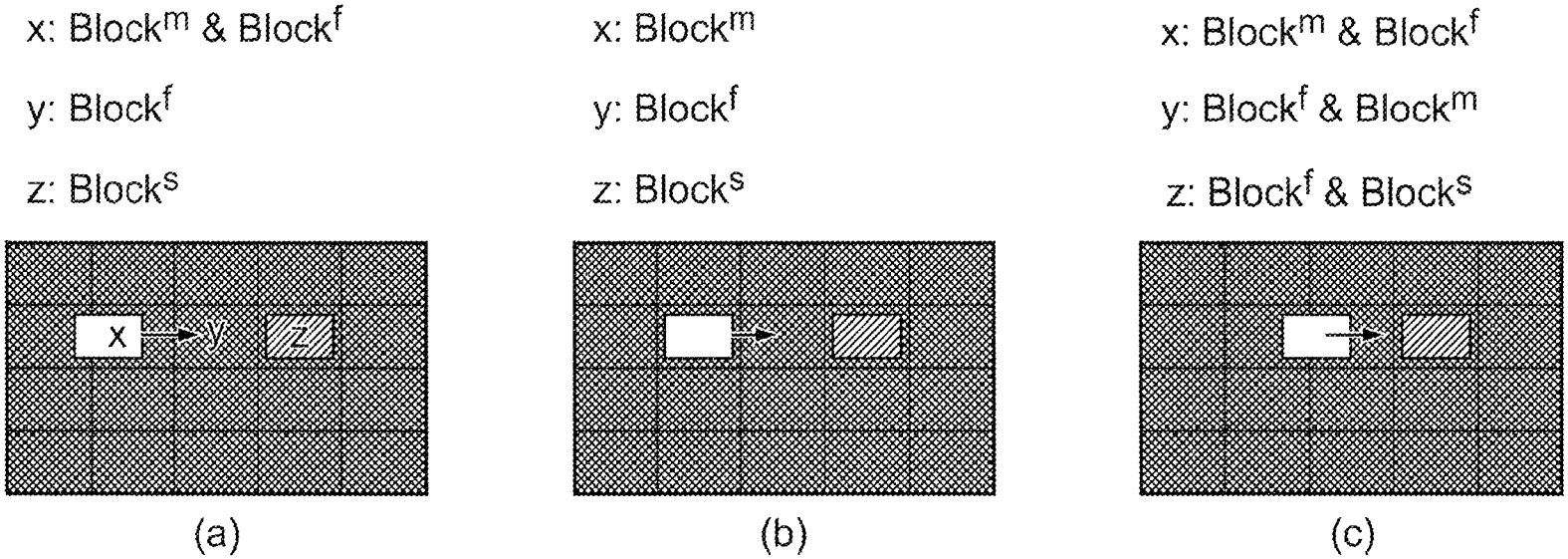
FIG. 9 (including parts (a)-(c)) is a simplified depiction of still more illustrative image information that is useful in explaining certain possible aspects of the disclosure.

As shown in the above pseudo-code, each block is categorized by three different types: $Block^s$ (still), $Block^m$ (moving), and $Block^f$ (filtered). (Precisely speaking, this categorization is "exclusive" for "still" and "moving," but "inclusive" for "filtered.") This categorization is a two-step operation. First, every block is categorized as either $Block^s$ or $Block^m$, depending on the amount of motion. Then, every block is additionally checked whether it is $Block^f$ or not. An example in FIG. 9 explains this two-step operation. Based on $G_{block}$ and their motion, we assume that blocks (x, y, z) are initially marked as ($Block^m$ & $Block^f$, $Block^f$, $Block^s$), respectively (FIG. 9(*a*)). When a white object is moving (FIG. 9(*b*)) and further moving to a standstill gray object (FIG. 9(*c*)), block y is further categorized as $Block^m$ and block z is further categorized as $Block^f$, respectively. When a block is doubly categorized, e.g., y and z in FIG. 9(*c*), using its $G_{block}$ we check the PWM duty ratio in each block category (compare FIG. 2(*c*) and FIG. 10) and select the maximum PWM duty ratio. The rationale of this MAX operation is that maintaining a constant viewer-perceived luminance from the bright moving object is more crucial than some amount of possible increase in halo/leakage from its surrounding areas.

In addition to the $G_{block}$ versus PWM duty ratio curve for $Block^s$ (FIG. 2(*c*)), FIG. 10(*a*) shows the curve for $Block^f$ and FIG. 10(*b*) shows the curve for $Block^m$. For the filtered block that employs the curve 1011, $G_{block}$ for use with curve 1011 originates from Max($G_{block}$, moving blocks only) of its 3×3 surrounding blocks, at least one of which is in motion. The level of $PWM^{sat}$ is empirically derived such that the earlier-described luminance fluctuation is hardly noticeable by turning on every surrounding block by a "just enough" amount. Any additional amount basically increases the unnecessary halo/leak in these surrounding/filtered blocks. Experimental results show that $PWM^{sat}$ is around 35%, which may vary across platforms with different grid size per dimmable block, different LED array structure, different LED brightness, etc. Note that all the surrounding blocks of a block in motion may contribute equal amounts of luminance to the bright object. $TH^{flat}$ which is also used in curve 1012 is explained in the next paragraph.

For a block labeled as $Block^m$, the PWM duty ratio is determined by following the curve 1012. Here, the level of $PWM^{flat}$ needs to be determined by considering two block-type conversions: 1) $Block^s \leftrightarrow Block^m$, 2) $Block^f \leftrightarrow Block^m$. These conversions, which actually deal with a point-to-point jump from one type of curve to another, can be better explained with an example:

1. Assume that there is a bright object in a block x and it is still. In this case, the backlight for block x is set to the maximum PWM duty ratio of 100% by following the curve 214 in FIG. 2(*c*).

2. When the object starts to move, the block x (which is $Block^s \rightarrow Block^m$) follows the curve 1012 and starts to get luminance aid from its surrounding blocks. To avoid luminance fluctuation at this time, we need to decrease block x's initial luminance in accordance with the increasing luminance aid from the surrounding blocks. The slope for the portion of [$TH^{flat}$:255] in curve 1012 reflects this point.

3. When the object further moves and enters a filtered block y (which is $Block^f \rightarrow Block^m$), we need to increase the luminance of block y from a certain point in curve 1011 to a certain point in curve 1012.

From these two conversions, it is known that 1) the curve for $Block^m$ lies between the curve for $Block^f$ and $Block^s$, and 2) the PWM values in curve 1012 need to decrease for $G_{block}$ change from 255 to $TH^{flat}$. The latter $G_{block}$ change corresponds to a decrease in luminance of block x; and during the change, block y has an increase in luminance. This increase and decrease in two blocks are dramatic and may be noticeable over the object. Therefore, we need to hide this movement/exchange in luminance (designated as a "luminance seesaw") because the bright object is supposed to maintain its luminance no matter where it is located and where it moves to.

One effective way of hiding this artifact is the introduction of a "flat band" relative to grayscale where the PWM value is saturated and constant. This "flat band" is shown in curve 1011, and due to this band, surrounding filtered blocks are untouched during the period of "luminance seesaw" while the luminance in block x is allowed to have a significant decrease. Note that the "flat band" in curve 1011 cannot continue to $G_{block}=0$, and the strength of the spatial filter needs to weaken from $PWM^{sat}$ to 0 starting at a certain grayscale value (since spatial filtering is not needed when $Max(G_{block})=0$); this grayscale value is denoted as $TH^{flat}$, and a typical value is $TH^{flat}=127$, which also may vary across platforms with different grid size per dimmable block, different LED array structure, different LED brightness, etc. Below this grayscale value, we linearly decrease the PWM duty ratio to 0.

During this region of [0:$TH^{flat}$], the strength of the spatial filter varies significantly and this results in a sudden change in halo/leak. To hide the halo/leak in surrounding blocks, we introduce a similar "flat band" for PWM in the grayscale range [$TH^{linear}$: $TH^{flat}$] as shown in curve 1012. Note that this "flat band" is for the block in motion, and that due to this, a block in motion is untouched during the period of halo/leak changes, while the luminance in surrounding blocks is allowed to have a rather significant decrease. Here, a typical value is $PWM^{flat}$=50%, which also may vary across platforms with different grid size per dimmable block, different LED array structure, different LED brightness, etc.

Similar to above, this "flat band" in curve 1012 cannot continue to $G_{block}$=0, and the PWM duty ratio should decrease from $PWM^{flat}$ to 0 starting at a certain grayscale value. For this grayscale value, denoted as $TH^{linear}$, we obtain $TH^{linear}$=$G_{block}$ from FIG. 2(*c*) at $PWM^{flat}$.

The above pseudo-code (and certain aspects of the above description) can be briefly summarized or recapitulated in somewhat different terms as follows:

(1) Every still block has $PWM^s$ from FIG. 2(*c*). (2) Every moving block has a $PWM^m$ from FIG. 10(*b*). (3) Every filtered block has a $PWM^f$ which is the largest value that results from applying FIG. 10(*a*) to each filtered block that is adjacent to the moving block. (In other words, the $G_{block}$ for each moving block that is adjacent to the filtered block is converted to a PWM value using FIG. 10(*a*), and then the largest of those PWM values becomes the $PWM^f$ of the filtered block. Alternatively (which produces the same result), the adjacent moving block having the largest $G_{block}$ value can be identified, and FIG. 10(*a*) can be applied to that largest $G_{block}$ value to produce $PWM^f$ for the filtered block.) (4) If a block is only a still block, then the final PWM for that block from the above pseudo-code is $PWM^s$. (5) If a block is only a moving block, then the final PWM for that block from the above pseudo-code is $PWM^m$. (6) If a block is both filtered and moving, then the final PWM for that block from the above pseudo-code is the larger of that block's $PWM^f$ and $PWM^m$. (7) If a block is both filtered and still, then the final PWM for that block from the above pseudo-code is the larger of that block's $PWM^f$ and $PWM^s$.

The next several paragraphs relate to the temporal filter aspects of the disclosure. In general, a temporal filter is a time-based filter that tends to smooth out abrupt changes in backlight brightness for each block by integrating that block's PWM values over several successive frames in order to produce a temporally filtered PWM value that is actually used to control the brightness of that block's backlight.

In practice, most of the previously described backlight-dimming-related-artifacts for objects in motion can be resolved by proper spatial filter design. However, there are certain instances when temporal filtering is also desirable. Those cases include:

1. Rapidly changing PWM duty ratio for a $Block^f$.

This can occur when a moving object in an image is appearing/disappearing to/from an LCD panel boundary.

2. Need for smooth transition between still images and images in motion.

To maximize the contrast difference between a bright object and its surrounding area in still images, the spatial filter is advantageously turned off.

To minimize the luminance fluctuation/degradation for an object in motion, the spatial filter needs to be turned on.

Figure 11:
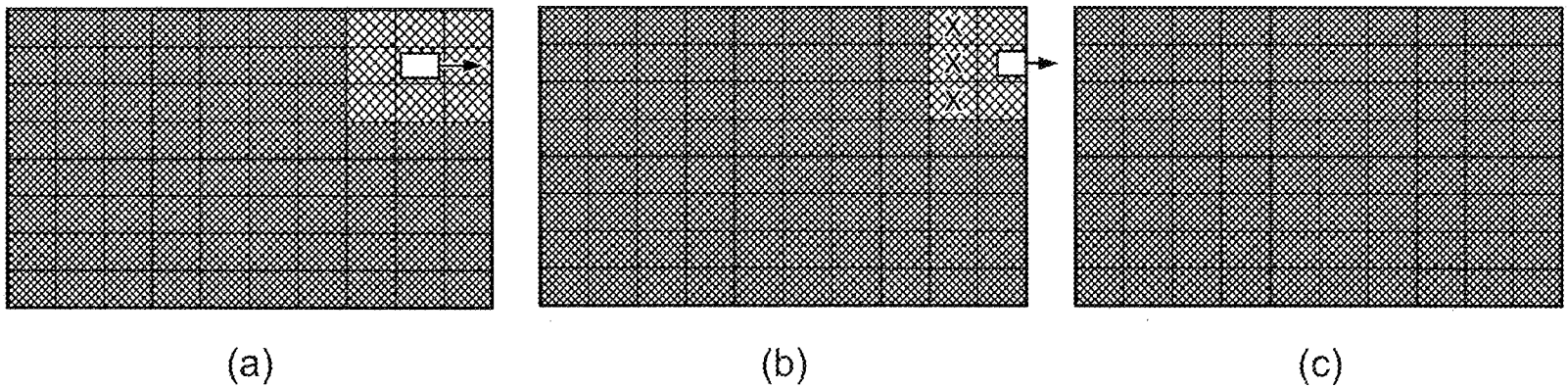
FIG. 11 (including parts (a)-(c)) is a simplified depiction of still more illustrative image information that is useful in explaining certain possible aspects of the disclosure.

FIG. 11 shows an example for the first case. When a bright object is disappearing from a panel as shown in FIG. 11(*a*)→(*b*)→(*c*), some of the spatially filtered blocks x may undergo relatively abrupt and noticeable changes in their PWM duty ratio. This abrupt change, which occurs relatively far from the disappearing object, is perceived as an abrupt degradation in halo/leak. A temporal filter is able to smooth out this abrupt change and make the degradation less noticeable.

Figure 12:
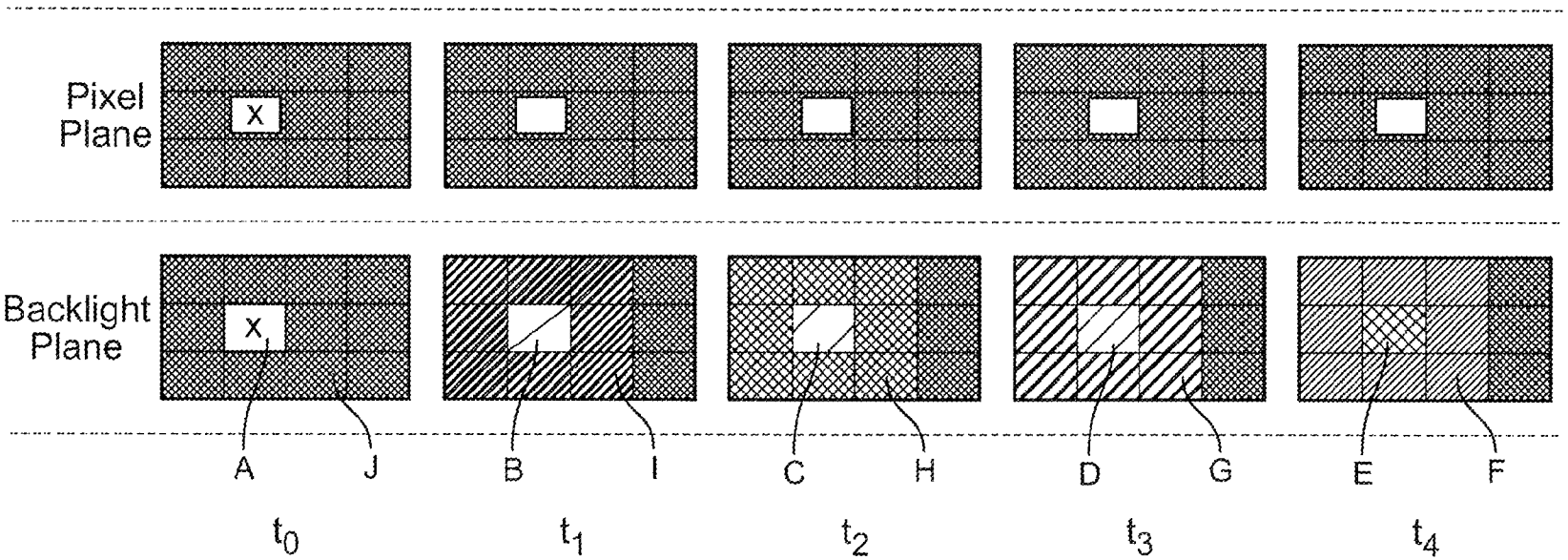
FIG. 12 is a simplified depiction of yet more illustrative image information (and associated backlight LED illumination) that is useful in explaining and illustrating certain possible aspects of the disclosure.

FIG. 12 depicts an example for the second case. When a bright object is still at $t_0$ and starts to move from $t_0$ to $t_4$ as shown in the pixel plane, the corresponding backlight status at each of $t_0$ to $t_4$ (with the application of a temporal filter) is shown in the backlight plane. Note that at to, only one backlight block is turned on. Hence a relatively high contrast difference between the bright and surrounding dark areas is achieved. When the object moves from $t_0$ to $t_4$, blocks in the backlight plane are rapidly changing by following the two curves in FIG. 10, but the pixel plane is changing slowly. Note that, in this case, overall image luminance (including the surrounding parts of the object) is increasing from $t_0$ to $t_4$. This luminance increase should be smooth and less noticeable, and this smooth-out can be achieved by the aid of a temporal filter. In an illustrative embodiment of the temporal filter, a moving average of the PWM duty ratio is used for each of backlight blocks. The size of the temporal filter, denoted by number of frames (N), is empirically determined to be 15, which may vary across platforms with different frame rate, different grid size per dimmable block, etc. In other words, the temporal filter averages the PWM for each block over the N most recent frames, where N may have a value such as 15.

Figure 1:
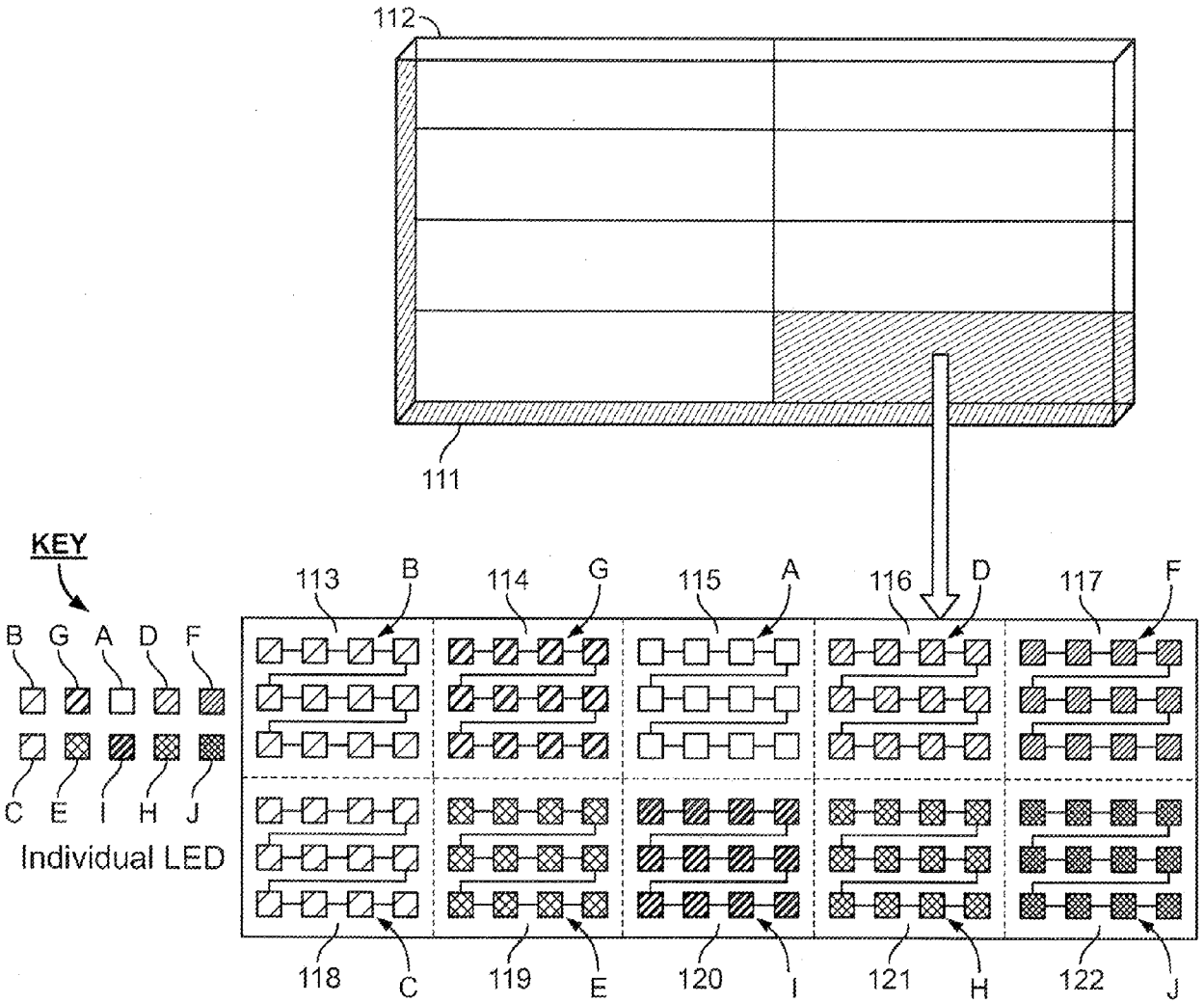
FIG. 1 is a simplified depiction of representative portions of an LCD with LED backlights.
Figure 13:
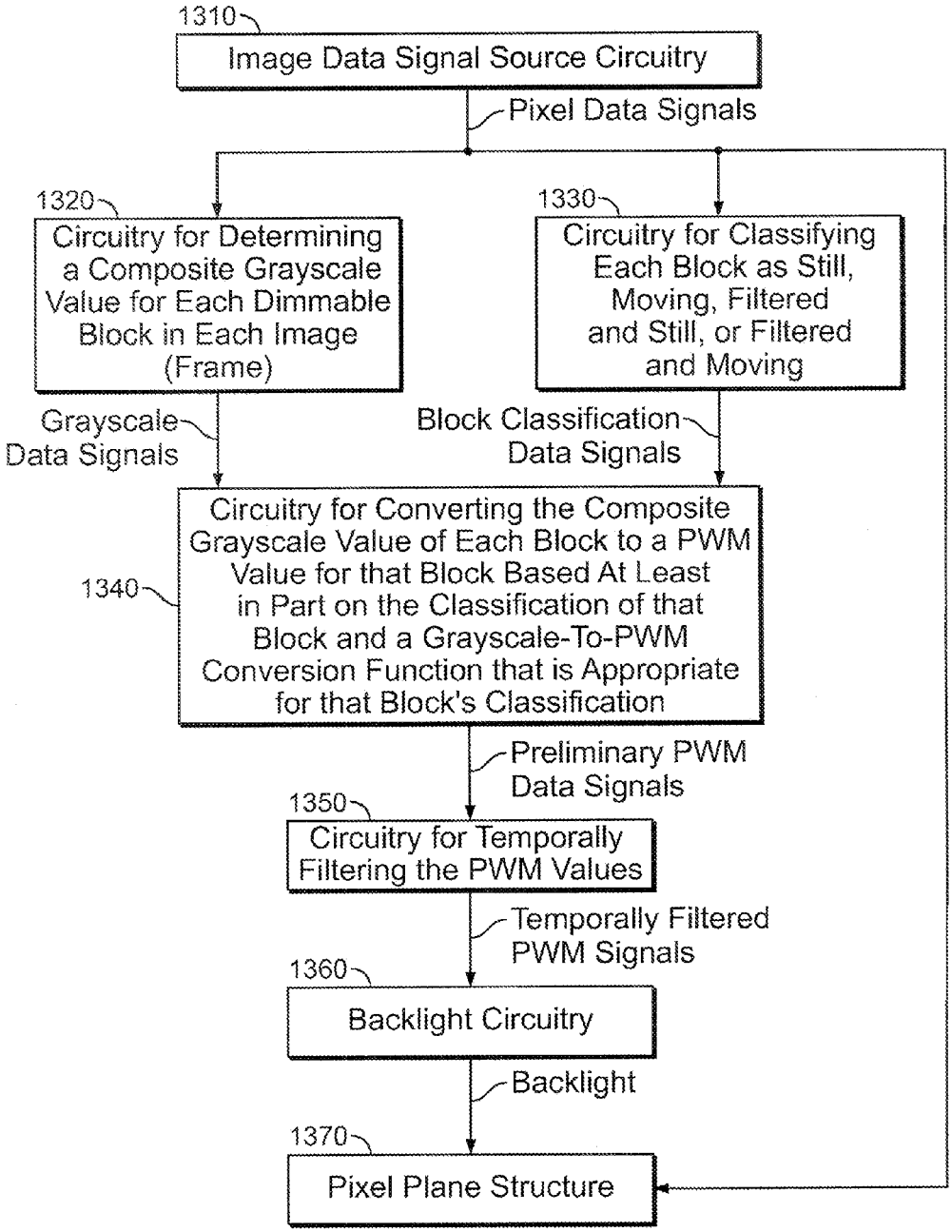
FIG. 13 is a simplified block diagram of an illustrative embodiment of apparatus in accordance with certain possible aspects of the disclosure.

An illustrative embodiment of more extensive apparatus in accordance with this disclosure is shown in FIG. 13. This apparatus may include image data signal source circuitry 1310, which provides signals that can be used to control the grayscale of each of the many pixels that make up pixel plane structure 1370 (like the pixel plane shown at 111 in FIG. 1). The above-described output signals of circuitry 1310 are also applied to circuitry 1320, which determines a composite grayscale value for each dimmable block in each image (frame). For example, this composite grayscale value (or grayscale characteristic) may be what was earlier described as $G_{block}$ or $G_{avg}$. The output signals of circuitry 1310 are also applied to circuitry 1330, which classifies each block in each image as (1) still, (2) moving, (3) filtered and still, or (4) filtered and moving in the manner described earlier in this specification. For example, a block may be classified as either still or moving based on the amount of image motion (change) in that block from one frame to the next succeeding frame. The sum of all pixel value changes between those two frames can be used in such a still-vs-moving-block determination. A block may additionally be classified as filtered if it is immediately adjacent to another block that is moving.

Signals indicative of the grayscale values determined by circuitry 1320 are applied to circuitry 1340. Signals indicative of the block classifications determined by circuitry 1330 are also applied to circuitry 1340. Circuitry 1340 uses the information in the signals applied to it to convert the composite grayscale value of each dimmable block to a PWM value for that block based at least in part on the classification of that block and a grayscale-to-PWM conversion function that is appropriate for that block's classification. In the case of a block that is classified as filtered (and still or moving), the function employed may also include consideration and use of the composite grayscale value of one or more other blocks that are adjacent to that block. The operations performed by circuitry 1340 (and the grayscale-to-PWM conversion functions employed by circuitry 1340) may all be as described earlier in this specification. Circuitry 1340 may output signals indicative of a preliminary PWM value for each block.

The preliminary PWM data signals output by circuitry 1340 are applied to circuitry 1350 for temporally filtering those preliminary PWM values as described earlier in this specification. The resulting temporally filtered PWM signals that circuitry 1350 outputs are applied to backlight circuitry 1360 (like element 112 in FIG. 1) to control the brightness of the backlight illumination of each dimmable block in circuitry 1360. The backlight produced by circuitry 1360 is, of course, used to backlight the pixel plane structure 1370 of the apparatus.

What is claimed is:

1. Display circuitry comprising:

a display plane including a plurality of pixels arranged in a block;

backlight circuitry for illuminating the block with a controllable amount of backlight;

circuitry for determining a grayscale characteristic of pixel data applied to the block; and circuitry for determining an amount of backlight based at least in part on the grayscale characteristic, wherein when the grayscale characteristic has any value greater than a threshold value ("$G_{LEAK}$") associated with a predetermined level of backlight leakage through a pixel, the amount of backlight determined by the circuitry for determining is a first amount, and when the grayscale characteristic has any value less than $G_{LEAK}$, the circuitry for determining reduces the amount of backlight from the first amount in proportion to how far the grayscale characteristic is below $G_{LEAK}$.

2. The circuitry defined in claim 1 wherein the grayscale characteristic is based on an average of grayscale values of a plurality of pixels in the block.

3. The circuitry defined in claim 1 wherein the grayscale characteristic is based on a weighted summation of grayscale values of a plurality of pixels in the block, and wherein a pixel having a grayscale value that is greater than a brightness threshold value ("$G_{SPLIT}$") is given greater weight in the weighted summation than a pixel having a grayscale value that is less than $G_{SPLIT}$.

4. The circuitry defined in claim 1 wherein the block is one of a plurality of similar blocks in the display plane; wherein the backlight circuitry is one of a plurality of backlight circuitries, each of which illuminates a respective one of the blocks with a respective controllable amount of backlight; wherein the circuitry for determining a grayscale characteristic determines that grayscale characteristic, respectively, for each of the blocks; and wherein the circuitry for determining the amount of backlight determines the amount of backlight for each respective block based at least in part on the grayscale characteristic of that block or the grayscale characteristic of another block that is adjacent to that block.

5. The circuitry defined in claim 1 wherein the backlight circuitry controls the amount of backlight using pulse width modulation ("PWM").

6. The circuitry defined in claim 5 wherein:

the backlight circuitry maintains a maximum PWM duty ratio when the grayscale characteristic is greater than $G_{LEAK}$; and the backlight circuitry decreases the PWM duty ratio when the grayscale characteristic is less than $G_{LEAK}$.

7. The circuitry defined in claim 6 wherein as the grayscale characteristic decreases below $G_{LEAK}$, the backlight circuitry decreases the PWM duty ratio linearly from the maximum PWM duty ratio.

8. The circuitry defined in claim 6 wherein as the grayscale characteristic decreases below $G_{LEAK}$, the backlight circuitry decreases the PWM duty ratio quasi-linearly from the maximum PWM duty ratio.

9. A method of controlling backlighting of a display including a plurality of pixels arranged in a block;

determining a grayscale characteristic of pixel data applied to the block; the method comprising:

determining an amount of backlight based at least in part on the grayscale characteristic, wherein when the grayscale characteristic has any value greater than a threshold value ("$G_{LEAK}$") associated with a predetermined level of backlight leakage through a pixel, the amount of backlight is determined to be a first amount, and when the grayscale characteristic has any value less than $G_{LEAK}$, the amount of backlight is determined to be reduced from the first amount in proportion to how far the grayscale characteristic is below $G_{LEAK}$; and applying the determined amount of backlight to the block.

10. The method defined in claim 9 wherein the grayscale characteristic is based on an average of grayscale values of a plurality of pixels in the block.

11. The method defined in claim 9 wherein the grayscale characteristic is based on a weighted summation of grayscale values of a plurality of pixels in the block, and wherein a pixel having a grayscale value that is greater than a brightness threshold value ("$G_{SPLIT}$") is given greater weight in the weighted summation than a pixel having a grayscale value that is less than $G_{SPLIT}$.

12. The method defined in claim 9 wherein:

the block is one of a plurality of similar blocks in a display plane;

the determining an amount of backlight, and the applying, are performed separately for each respective one of the blocks;

the determining a grayscale characteristic determines that grayscale characteristic, respectively, for each of the blocks; and the determining the amount of backlight determines the amount of backlight for each respective block based at least in part on the grayscale characteristic of that block or the grayscale characteristic of another block that is adjacent to that block.

13. The method defined in claim 9 wherein the applying applies a determined amount of backlight using pulse width modulation ("PWM").

14. The method defined in claim 13 wherein the applying comprises:

maintaining a maximum PWM duty ratio when the grayscale characteristic is greater than $G_{LEAK}$; and decreasing the PWM duty ratio when the grayscale characteristic is less than $G_{LEAK}$.

15. The method defined in claim 14 wherein as the grayscale characteristic decreases below $G_{LEAK}$, the PWM duty ratio is decreased linearly from the maximum PWM duty ratio.

16. The method defined in claim 14 wherein as the grayscale characteristic decreases below $G_{LEAK}$, the PWM duty ratio is decreased quasi-linearly from the maximum PWM duty ratio.

* * * * *